US009550274B2

(12) United States Patent
Tagscherer

(10) Patent No.: US 9,550,274 B2
(45) Date of Patent: Jan. 24, 2017

(54) PROTECTIVE HOOD DEVICE

(71) Applicant: Robert Bosch GmbH, Stuttgart (DE)

(72) Inventor: Theo Tagscherer, Gaildorf (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/258,779

(22) Filed: Apr. 22, 2014

(65) Prior Publication Data

US 2014/0342645 A1 Nov. 20, 2014

(30) Foreign Application Priority Data

May 14, 2013 (DE) ..... 10 2013 208 809

(51) Int. Cl.
*B24B 23/02* (2006.01)
*B24B 55/05* (2006.01)

(52) U.S. Cl.
CPC ..... *B24B 55/052* (2013.01); *B24B 23/028* (2013.01)

(58) Field of Classification Search
CPC ..... B24B 23/028; B24B 23/02; B24B 55/052; B24B 55/05
USPC ..... 451/358, 359, 451, 452, 454
See application file for complete search history.

(56) References Cited

U.S. PATENT DOCUMENTS

| | | | | |
|---|---|---|---|---|
| 2,741,282 | A * | 4/1956 | Wieting | B27B 5/08 144/251.1 |
| 3,177,909 | A * | 4/1965 | Laube et al. | 30/391 |
| 3,721,141 | A * | 3/1973 | Frostad | B27B 9/02 144/251.1 |
| 3,882,598 | A * | 5/1975 | Earle et al. | 30/390 |
| 4,924,635 | A * | 5/1990 | Rudolf | B24B 55/052 451/344 |
| 5,974,674 | A * | 11/1999 | Kelly | 30/391 |
| 7,892,075 | B2 * | 2/2011 | Esenwein | B24B 55/052 451/344 |
| 8,523,637 | B2 * | 9/2013 | Loveless | B24B 23/028 451/356 |
| 8,939,816 | B2 * | 1/2015 | Chen | 451/359 |
| 2009/0229436 | A1 * | 9/2009 | Crain et al. | 83/373 |
| 2009/0311953 | A1 * | 12/2009 | Maute et al. | 451/359 |
| 2012/0052779 | A1 * | 3/2012 | Timcke et al. | 451/451 |

* cited by examiner

*Primary Examiner* — Robert Rose
(74) *Attorney, Agent, or Firm* — Maginot, Moore & Beck LLP

(57) ABSTRACT

A protective hood device with at least one protective hood basic body is configured to at least partially cover an insertable tool of a portable power tool. The protective hood device has at least one functional recess, and at least one covering unit which is mounted on the at least one protective hood basic body so as to be movable relative to the at least one protective hood basic body. The at least one covering unit is configured to cover the at least one functional recess of the at least one protective hood basic body in at least one first position. The at least one protective hood device further includes a locking unit which is configured to lock the at least one covering unit in the at least one first position relative to the at least one protective hood basic body.

17 Claims, 4 Drawing Sheets

PROTECTIVE HOOD DEVICE

This application claims priority under 35 U.S.C. §119 to patent application no. DE 10 2013 208 809.4, filed on May 14, 2013 in Germany, the disclosure of which is incorporated herein by reference in its entirety.

BACKGROUND

A protective hood device has already been proposed.

SUMMARY

The disclosure is based on a protective hood device, in particular a portable power tool protective hood device, with at least one protective hood basic body which is provided to at least partially cover an insertable tool of a portable power tool and which has at least one functional recess, and with at least one covering unit which is mounted on the protective hood basic body so as to be movable relative to the protective hood basic body and which is provided to cover the functional recess of the protective hood basic body in at least one first position.

It is proposed that the protective hood device has a locking unit which is provided to lock the covering unit in the at least one first position relative to the protective hood basic body. In this context, "to cover" is to be understood as meaning, in particular, that the protective hood basic body is at least partially, preferably at least virtually completely, arranged in front of the insertable tool in at least one spatial direction, in particular in the radial direction, as viewed from the outside inward, and/or in the axial direction, as viewed from the portable power tool toward the insertable tool. A "functional recess" in this context is to be understood as meaning, in particular, an immaterial region which preferably, is viewed from a surface of the protective hood basic body, at least partially extends through a material thickness of the protective hood basic body in a normal direction of the surface of the protective hood basic body and which is at least partially provided so as to provide a function supporting operation of the portable power tool and/or a necessary function and/or at least one portable power tool function which is at least partially essential for an operating state. In this context, "at least partially" is to be understood as meaning, in particular, at least 50%, preferably at least 75%, preferably at least 90% and particularly preferably at least 98% of the material thickness of the protective hood basic body. The functional recess is preferably provided to increase a machining region of the insertable tool in order, for example, to permit machining of a transition region between at least two surfaces, such as, in particular, between a wall and a floor or a ceiling, and/or machining close to an edge. However, other functions appearing expedient to a person skilled in the art are also conceivable.

In this context, "mounted movably" is to be understood as meaning, in particular, a mounting of the covering unit so as to enable the covering unit to move relative to the protective hood basic body along at least one distance of greater than 10 mm, preferably of greater than 20 mm and particularly preferably of greater than 50 mm, and/or about at least one axis, in particular about an axis of rotation of the insertable tool, by an angle of greater than 10°, preferably of greater than 25° and particularly preferably of greater than 45°. "Provided" is to be understood as meaning, in particular, specially configured, designed and/or equipped. That an object is provided for a certain function is to be understood as meaning, in particular, that the object implements and/or carries out this certain function in at least one use state and/or operating state. In this context, a "position" is to be understood as meaning, in particular, an end position of the covering unit relative to the protective hood basic body. In this context, "to lock" is to be understood as meaning, in particular, a preferably releasable coupling between the protective hood basic body and the covering unit, wherein a locking force can be transmitted between the protective hood basic body and the covering unit, and wherein a relative movement between the protective hood basic body and the covering unit can amount to in particular less than 5 mm, preferably less than 3 mm and particularly preferably less than 1 mm and/or less than 5°, preferably less than 3° and particularly preferably less than 1°.

By means of the configuration according to the disclosure, an advantageously high level of operator comfort and a preferably high level of operating safety can be achieved.

Furthermore, it is proposed that the locking unit is provided to lock the covering unit relative to the protective hood basic body in at least one further position, in which the covering unit at least partially releases the functional recess of the protective hood basic body in at least one further position. In this context, a "position" is to be understood as meaning, in particular, an end position of the covering unit relative to the protective hood basic body. "To release" in this context is to be understood as meaning, in particular, that the insertable tool of the portable power tool is designed to be freely accessible in at least one spatial direction, in particular in the radial direction, as viewed from the outside inward, and/or in the axial direction, as viewed from the portable power tool toward the insertable tool. "To lock" is to be understood in this context as meaning, in particular, a preferably releasable coupling between the protective hood basic body and the covering unit, wherein a locking force can be transmitted between the protective hood basic body and the covering unit, and wherein a relative movement between the protective hood basic body and the covering unit can amount to in particular less than 5 mm, preferably less than 3 mm and particularly preferably less than 1 mm and/or less than 5°, preferably less than 3° and particularly preferably less than 1°. As a result, an advantageously high level of operator comfort and preferably good and flexible machining of a workpiece to be machined can be achieved.

Furthermore, it is proposed that the covering unit is mounted displaceably relative to the protective hood basic body. "Mounted displaceably" in this context is to be understood as meaning, in particular, movable along a guideline. The covering unit can preferably be mounted displaceably in the radial and/or circumferential direction. As a result, a structurally simple configuration of the protective hood device can be achieved.

Furthermore, it is proposed that the covering unit is mounted pivotably relative to the protective hood basic body. "Mounted pivotably" in this context is to be understood as meaning, in particular, movable about an axis. In a particularly preferred exemplary embodiment, the covering unit is mounted pivotably about an axis of rotation of the insertable tool of the portable power tool. As a result, a structurally simple configuration of the protective hood device can be achieved.

In addition, it is proposed that the locking unit comprises at least one blocking element which is connected movably to the covering unit. "Connected movably" in this context is to be understood as meaning, in particular, a mounting of the blocking element that enables the blocking element to move relative to the covering unit along at least one distance of greater than 10 mm, preferably of greater than 20 mm and particularly preferably of greater than 50 mm and/or about at least one axis, in particular about an axis of rotation of the insertable tool, about an angle of greater than 10°, preferably of greater than 25° and particularly preferably of greater than 45°. As a result, an advantageously simple configuration and a preferably high level of operating comfort can be achieved.

Furthermore, it is proposed that the locking unit has at least one spring element, counter to the spring force of which the at least one blocking element is movably mounted. A "spring element" is to be understood as meaning, in particular, a macroscopic element which has at least one extent which, in a normal operating state, is elastically changeable by at least 10%, in particular by at least 20%, preferably by at least 30% and particularly advantageously by at least 50%, and which, in particular, produces a counterforce which is dependent on a change in the extent and is preferably proportional to the change and counteracts the change. An "extent" of an element is to be understood as meaning, in particular, a maximum distance between two points of a perpendicular projection of the element onto a plane. A "macroscopic element" is to be understood as meaning, in particular, an element with an extent of at least 1 mm, in particular of at least 5 mm and preferably of at least 10 mm. In this context, "movably mounted" is to be understood as meaning, in particular, a mounting of the blocking element which enables the blocking element to move counter to a spring force of the spring element along at least one extent of greater than 10 mm, preferably of greater than 20 mm and particularly preferably of greater than 50 mm and/or about at least one axis, in particular about an axis of rotation of the insertable tool, by an angle of greater than 10°, preferably of greater than 25° and particularly preferably of greater than 45°. The spring element can preferably be formed by a tension spring, a leaf spring, a torsion spring, a disk spring and particularly preferably by a compression spring. As a result, a preferably simple and advantageously secure locking of the covering unit can be achieved.

Furthermore, it is proposed that the protective hood basic body has at least one first locking recess which is provided to correspond to the at least one blocking element of the locking unit and to define a first position of the covering unit. In this context, a "locking recess" is to be understood as meaning, in particular, an immaterial region which, as viewed from a surface of the protective hood basic body, preferably extends at least partially through a material thickness of the protective hood basic body in the normal direction of the surface of the protective hood basic body, and which is at least partially provided to lock the covering unit, in particular by corresponding to the at least one blocking element. In this context, "at least partially" is to be understood as meaning, in particular, at least 50%, preferably at least 75%, preferably at least 90% and particularly preferably at least 98% of the material thickness of the protective hood basic body. As a result, an advantageously simple and reliable configuration of the locking unit and a preferably high level of operating comfort can be achieved.

In addition, it is proposed that the protective hood basic body has at least one further locking recess which is provided to define the further position of the covering unit. In this context, a "locking recess" is to be understood as meaning, in particular, an immaterial region which, as viewed from a surface of the protective hood basic body, preferably extends at least partially through a material thickness of the protective hood basic body in the normal direction of the surface of the protective hood basic body, and which is at least partially provided to lock the covering unit, in particular by corresponding to the at least one blocking element. In this context, "at least partially" is to be understood as meaning, in particular, at least 50%, preferably at least 75%, preferably at least 90% and particularly preferably at least 98% of the material thickness of the protective hood basic body. As a result, an advantageously simple and reliable configuration of the locking unit and a preferably high level of operating comfort can be achieved. In this context, "to define" is to be understood as meaning, in particular, to determine and/or to specify. As a result, a preferably simple and advantageously secure locking of the covering unit can be achieved.

Furthermore, it is proposed that the at least one locking unit is at least partially mounted displaceably in the radial direction. "Mounted displaceably" in this context is to be understood as meaning, in particular, a mounting of the blocking element that enables the blocking element to move linearly along at least one distance of greater than 10 mm, preferably of greater than 20 mm and particularly preferably of greater than 50 mm. As a result, an advantageously simple and reliable configuration of the locking unit, a preferably high level of operating comfort an, preferably, simple and, in particular, tool-free locking of the covering unit can be achieved.

In addition, it is proposed that the at least one blocking element is at least partially provided for form-fitting locking of the covering unit. "Form-fitting" is to be understood as meaning, in particular, that surfaces bearing against one another of components connected to one another in a form-fitting manner, in particular of the at least one blocking element and of at least one of the at least two locking recesses, exert a holding force, which acts in the normal direction of the surfaces, on one another. In particular, the components are in geometrical engagement with one another. As a result, an advantageously simple and reliable configuration of the locking unit and a preferably high level of operating comfort can be achieved.

In addition, a portable power tool with a protective hood device according to the disclosure is proposed.

The protective hood device according to the disclosure is not intended to be limited here to the above-described use and embodiment. In particular, in order to carry out a function described herein, the protective hood device according to the disclosure can have a number differing from a number mentioned herein of individual elements, components and units.

BRIEF DESCRIPTION OF THE DRAWINGS

Further advantages emerge from the description below of the drawings. The drawings illustrate an exemplary embodiment of the disclosure. The drawings, the description and the claims contain numerous features in combination. A person skilled in the art will expediently also consider the features individually and put them together to form meaningful further combinations.

In the drawings.

DETAILED DESCRIPTION

Figure 1:
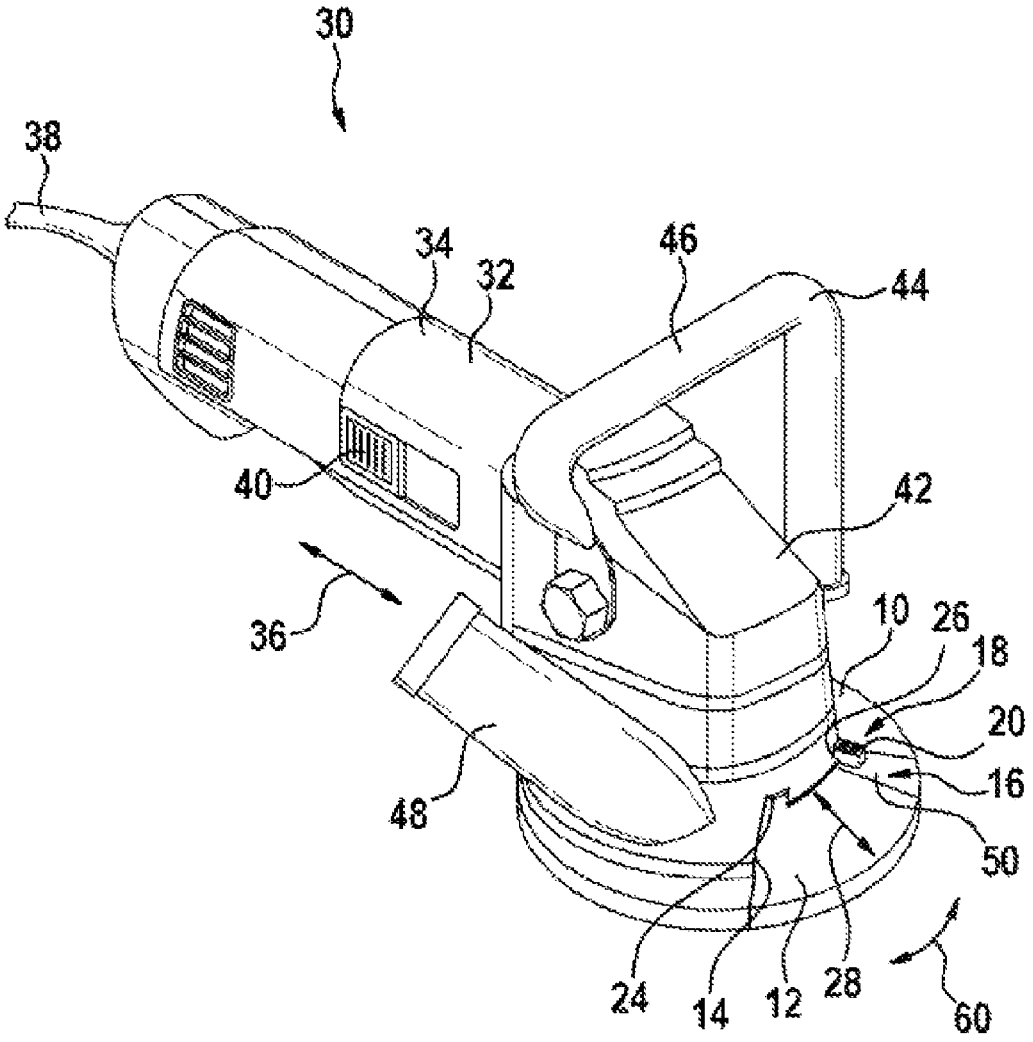
FIG. 1 shows a perspective view of a portable power tool with a protective hood device according to the disclosure.

FIG. 1 illustrates a portable power tool 30 which is designed as a concrete grinder. However, other configurations of the portable power tool 30 that appear expedient to a person skilled in the art, such as, for example, in the form of angle grinders, are also conceivable. The portable power tool 30 comprises a housing 32. The housing 32 is formed from a plastic. The housing 32 forms a main handle 34 which is provided to be grasped by a hand of an operator. A power cable 38 is arranged at one end of the housing 32, as viewed in the main direction of extent 36 of the portable power tool 30. The power cable 38 is provided for supplying a drive unit (not illustrated) of the portable power tool 30 with electrical energy. The power cable 38 is provided to be connected to an electric power grid. For this purpose, the power cable 38 has a plug element (not illustrated). However, it is also conceivable for the portable power tool 30 to be formed by a battery-operated portable power tool. Furthermore, the portable power tool 30 has a switching element 40 which is designed to be actuable by an operator. The switching element 40 is provided for activating the drive unit. The switching element 40 is formed by a switching slide.

The portable power tool 30 furthermore has a gearing housing 42. The gearing housing 42 is connected to the housing 32 at an end of the housing 32 that is opposite the power cable 38. The gearing housing 42 is formed from a metal. The gearing housing 42 is formed from aluminum. The portable power tool 30 comprises a tool-holding fixture (not illustrated specifically) which is provided to receive and to captively hold an insertable tool 12. The insertable tool 12 is formed by a grinding wheel. The insertable tool 12 is connected releasably to the tool-holding fixture.

The tool-holding fixture is arranged at an open end of the gearing housing 42, as viewed perpendicularly to the main direction of extent 36 of the portable power tool 30. The tool-holding fixture protrudes out of the gearing housing 42.

The portable power tool 30 also has an additional handle 44. The additional handle 44 is provided to be grasped by a further hand of the operator. The additional handle 44 is coupled releasably to the portable power tool 30. The additional handle 44 is of arcuate configuration. A gripping region 46 of the additional handle 44 extends perpendicularly to the main handle 34. The additional handle 44 is arranged on a side of the gearing housing 42 that faces away from the tool-holding fixture. However, it is also conceivable for the handle region 46 of the additional handle 44 to be arranged in an extension to a grinding spindle of the portable power tool, said grinding spindle being provided to transmit a driving movement of the drive unit to the insertable tool 12 in an operating state.

Furthermore, a protective hood device is fastened to the portable power tool 30. The protective hood device is designed as a portable power tool protective hood device. The protective hood device is arranged at an end of the portable power tool 30 that faces the tool-holding fixture. The protective hood device is fixedly connected to the portable power tool 30. However, it is also conceivable for the protective hood device to be coupled releasably to the portable power tool 30. The protective hood device is provided to protect an operator from the rotating insertable tool 12 in an operating state of the portable power tool 30 and to prevent contact between the operator and the insertable tool 12. The protective hood device has a connecting element 48 which can be coupled to a suction hose of a suction device, for example a vacuum cleaner. The connecting element 48 forms a suction channel. The protective hood device comprises a protective hood basic body 10 which is provided to cover the insertable tool 12 of the portable power tool 30. The protective hood basic body 10 is of circular design. The protective hood basic body 10 has a functional recess 14. The function recess 14 is provided to release the insertable tool 12 in a partial region such that machining, for example at a wall, is possible. The functional recess 14 is of arcuate design. The functional recess 14 is arranged in a radially outer region of the protective hood basic body 10. The suction device can furthermore be provided to collect dust occurring in a machining state of the portable power tool by means of dust brushes (not illustrated) coupled to the protective hood basic body 10 and preferably to conduct the dust to the connecting element 48.

Figure 2A:
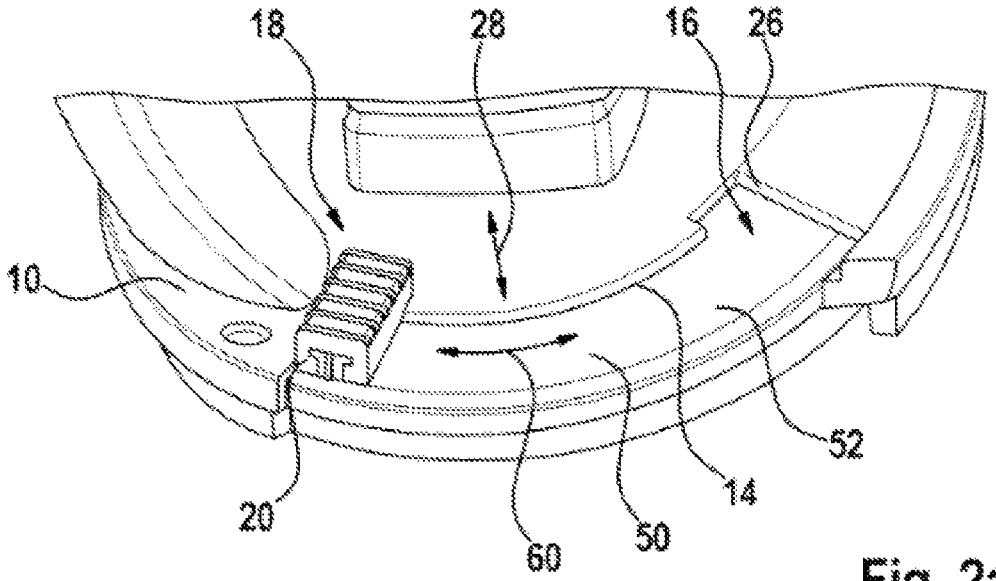
FIG. 2*a* shows a perspective view of a detail of the protective hood device according to the disclosure in a first position.
Figure 2B:
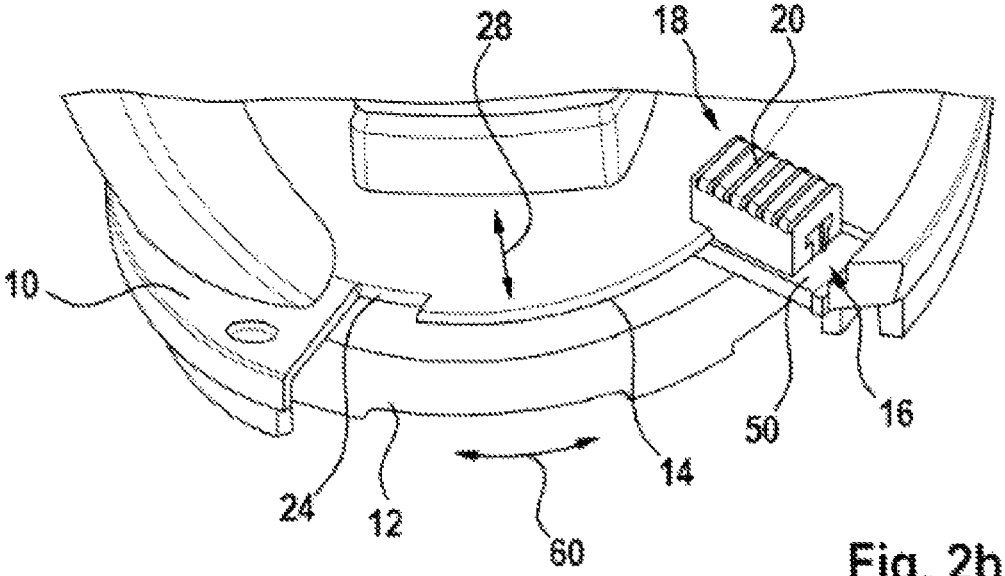
FIG. 2*b* shows a perspective view of the detail of the protective hood device according to the disclosure in a further position.
Figure 3A:
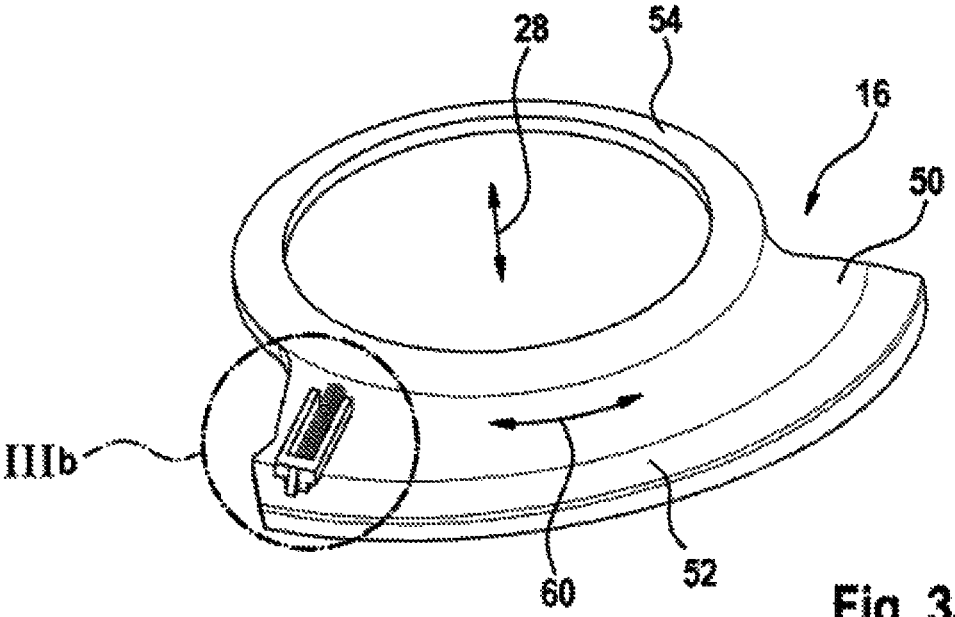
FIG. 3*a* shows a perspective view of a covering unit of the protective hood device according to the disclosure.

The protective hood device furthermore has a covering unit 16 which is mounted movably relative to the protective hood basic body 10. The covering unit 16 is mounted movably on the protective hood basic body 10. The covering unit 16 is mounted displaceably relative to the protective hood basic body 10. The covering unit 16 is mounted pivotably relative to the protective hood basic body 10. The covering unit 16 is provided to cover the functional recess 14 of the protective hood basic body 10 in a first position (FIG. 2*a*). In addition, the covering unit 16 is provided to release the functional recess 14 of the protective hood basic body 10 in a further position (FIG. 2*b*). The covering unit 16 comprises a covering basic body 50 (FIG. 3*a*). The covering basic body 50 is mounted pivotably relative to the protective hood basic body 10. The covering basic body 50 is provided to cover the functional recess 14 of the protective hood basic body 10 in the first position. In addition, the covering basic body 50 is provided to release the functional recess 14 of the protective hood basic body 10 in the further position. In a state of the protective hood device mounted on the portable power tool 30, the covering basic body 50 is mounted pivotably about an axis of rotation of the insertable tool 12. The covering basic body 50 has an arcuate covering region 52 and an annular guide region 54. The covering basic body 50 has a smaller extent in the radial direction 28 than the protective hood basic body 10. In the further position, the covering basic body 50 is arranged radially within the protective hood basic body 10.

Figure 4:
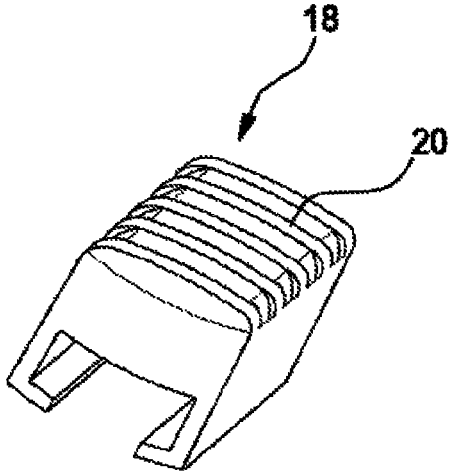
FIG. 4 shows a perspective rear view of a blocking element of a locking unit of the protective hood device according to the disclosure.
Figure 5:
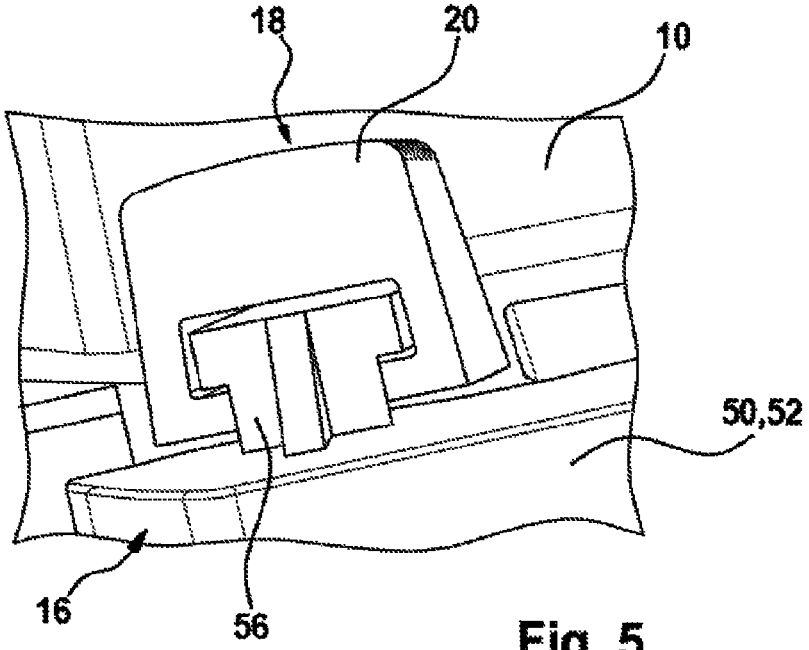
FIG. 5 shows a perspective view of a detail of the protective hood device according to the disclosure.

In addition, the protective hood device comprises a locking unit 18. The locking unit 18 is provided to lock the covering unit 16 of the first position relative to the protective hood basic body 10. In addition, the locking unit 18 is provided to lock the covering unit 16 of the further position, in which the covering unit 16 releases the functional recess 14 of the protective hood basic body 10, relative to the protective hood basic body 10. The locking unit 18 has a blocking element 20 (FIG. 4). The blocking element 20 is connected movably to the covering unit 16. The blocking element 20 is connected movably to the covering basic body 50 of the covering unit 16. The blocking element 20 is mounted displaceably relative to the covering basic body 50. The blocking element 20 is coupled captively to the covering basic body 50 of the covering unit 16. The blocking element 20 is coupled in a form-fitting manner to a holding extension 56 of the covering basic body 50. The holding extension 56 forms a locking unit guide element. The holding extension 56 is formed integrally with the covering basic body 50. The holding extension 56 has a T-shaped front view. The blocking element 20 engages around the holding extension 56 (FIG. 5). In a fitted state of the protective hood device, the blocking element 20 is held captively parallel to the axis of rotation of the insertable tool 12. The blocking element 20 is designed to be displaceable in the radial direction 28 relative to the holding extension 56. The blocking element 20 is mounted displaceably in the radial direction 28 of the protective hood device. The holding extension 56 forms a guide of the blocking element 20 in the radial direction 28. The blocking element 20 is formed by a slide.

Figure 3B:
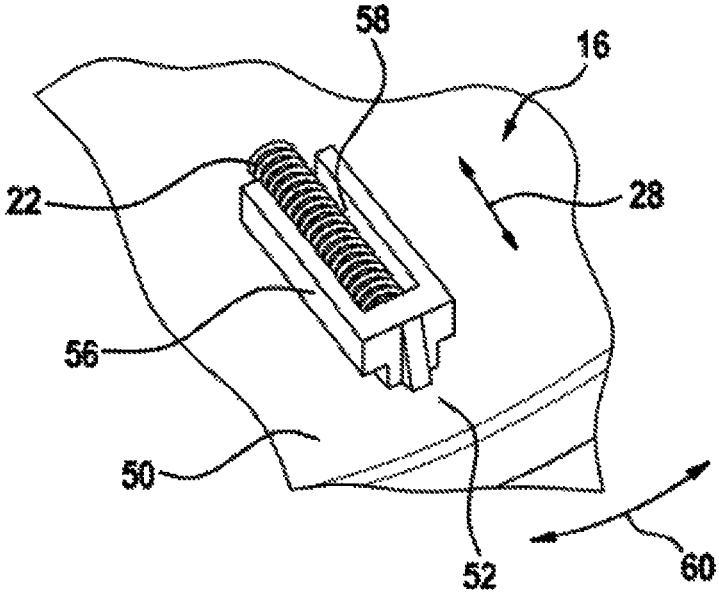
FIG. 3*b* shows a perspective view of a detail of the covering unit of the protective hood device according to the disclosure.

The locking unit 18 comprises a spring element 22, counter to the spring force of which the blocking element 20 is mounted movably. As viewed parallel to the axis of rotation of the insertable tool 12, the holding extension 56 of the covering basic body 50 has a U-shaped recess 58 in which the spring element 22 is arranged (FIG. 3*b*). The spring element 22 is formed by a compression spring. The spring element 22 is formed by a spiral spring. The spring element 22 is supported on the holding extension 56 of the covering basic body 50 in the radial direction 28. In a mounted state, the spring force of the spring element 22 presses the blocking element 20 inward in the radial direction 28 toward the axis of rotation of the insertable tool 12. The blocking element 20 is displaceable outward in the radial direction 28 relative to the holding extension 56 of the covering basic body 50 counter to the spring force of the spring element 22. An operator of the portable power tool 30 can displace the blocking element 20 outward in the radial direction 28 counter to the spring force of the spring element 22. As soon as the operator of the portable power tool 30 releases the blocking element 20, the blocking element 20 automatically moves inward in the radial direction 28 because of the spring force of the spring element 22. The locking unit 18 is provided to prevent an automatic pivoting of the covering unit 16 from the first position into the further position or vice versa.

The protective hood basic body 10 has a first locking recess 24 which is provided to correspond to the blocking element 20 of the locking unit 18 and to define the first position of the covering unit 16. The protective hood basic body 10 has a further locking recess 26 which is provided to correspond to the blocking element 20 of the locking unit 18 and to define the further position of the covering unit 16. The first locking recess 24 is provided to correspond to the blocking element 20 in the first position of the covering unit 16, in which position the covering basic body 50 covers the functional recess 14. The further locking recess 26 is provided to correspond to the blocking element 20 in the further position of the covering unit 16, in which position the covering basic body 50 releases the functional recess 14. The first locking recess 24 and the further locking recess 26 are arranged in the region of the functional recess 14 of the protective hood basic body 10. The first locking recess 24 and the further locking recess 26 extend inward in the radial direction 28. As viewed in the circumferential direction 60, the first locking recess 24 is arranged at a first end of the functional recess 14 of the protective hood basic body 10. As viewed in the circumferential direction 60, the further locking recess 26 is arranged at a second end, which is remote from the first end, of the functional recess 40 of the protective hood basic body 10. The first locking recess 24 and the further locking recess 26 are spaced apart from each other, as viewed in the circumferential direction 60. The first locking recess 24 and the further locking recess 26 and the blocking element 20 are provided for form-fitting locking of the covering unit 16. In the first position of the covering basic body 50, the blocking element 20 latches into the first locking recess 24 of the protective hood basic body 10 and locks the covering unit 16 relative to the protective hood basic body 10 such that the covering basic body 50 covers the functional recess 14. In the further position of the covering basic body 50, the blocking element 20 latches into the further locking recess 26 of the protective hood basic body 10 and locks the covering unit 16 relative to the protective hood basic body 10 such that the covering basic body 50 releases the functional recess 14.

What is claimed is:

1. A protective hood device for a portable power tool, comprising:

at least one protective hood basic body configured to at least partially cover an insertable tool of a portable power tool, wherein the at least one protective hood basic body includes at least one functional recess;

at least one covering unit which is mounted on the at least one protective hood basic body so as to be movable relative to the at least one protective hood basic body, and which is configured to cover the at least one functional recess of the at least one protective hood basic body in at least one first position; and a locking unit configured to lock the at least one covering unit in the at least one first position relative to the at least one protective hood basic body, wherein the insertable tool defines an axis of rotation, wherein the locking unit includes at least one blocking element which is movably connected to the at least one covering unit, and wherein the at least one blocking element is configured for movement relative to the at least one covering unit in only a radial direction relative to the axis of rotation.

2. The protective hood device according to claim 1, wherein the locking unit is configured to lock the at least one covering unit relative to the at least one protective hood basic body in at least one further position in which the at least one covering unit at least partially releases the functional recess.

3. The protective hood device according to claim 1, wherein the at least one covering unit is displaceably mounted relative to the protective hood basic body.

4. The protective hood device according to claim 1, wherein the at least one covering unit is pivotably mounted relative to the at least one protective hood basic body.

5. The protective hood device according to claim 1, wherein:

the at least one covering unit includes a holding extension configured to be slidably received within a correspondingly shaped opening in the at least one blocking element;

the locking unit includes at least one spring element at least partially received by the holding extension; and the at least one blocking element is movably mounted counter to a spring force of the at least one spring element.

6. The protective hood device according to claim 1, wherein the at least one protective hood basic body includes at least one first locking recess which corresponds to the at least one blocking element and defines the at least one first position of the at least one covering unit.

7. A protective hood device for a portable power tool, comprising:

at least one protective hood basic body configured to at least partially cover an insertable tool of a portable power tool, wherein the at least one protective hood basic body includes at least one functional recess;

at least one covering unit which is mounted on the at least one protective hood basic body so as to be movable relative to the at least one protective hood basic body, and which is configured to cover the at least one functional recess of the at least one protective hood basic body in at least one first position; and a locking unit configured to lock the at least one covering unit in the at least one first position relative to the at least one protective hood basic body, wherein the at least one protective hood basic body includes at least one first locking recess which corresponds to the at least one blocking element and defines the at least one first position of the at least one covering unit, wherein the locking unit includes at least one blocking element which is movably connected to the at least one covering unit, and wherein the at least one protective hood basic body includes at least one further locking recess that defines the at least one further position of the at least one covering unit.

8. The protective hood device according to claim 1, wherein the at least one blocking element is at least partially configured to form-fit lock the at least one covering unit.

9. A portable power tool comprising:

a housing; and a protective hood device that includes:

at least one protective hood basic body configured to at least partially cover an insertable tool of the portable power tool, the at least one protective hood basic body including at least one functional recess, and the at least one protective hood basic body fixedly connected to the housing;

at least one covering unit mounted on the at least one protective hood basic body so as to be movable relative to the at least one protective hood basic body, and configured to cover the at least one functional recess of the at least one protective hood basic body in at least one first position; and a locking unit configured to lock the at least one covering unit in the at least one first position relative to the at least one protective hood basic body, wherein the locking unit includes at least one blocking element which is movably connected to the at least one covering unit.

10. The portable power tool according to claim 9, wherein the locking unit is configured to lock the at least one covering unit relative to the at least one protective hood basic body in at least one further position in which the at least one covering unit at least partially releases the functional recess.

11. The portable power tool according to claim 9, wherein the at least one covering unit is displaceably mounted relative to the protective hood basic body.

12. The portable power tool according to claim 9, wherein the at least one covering unit is pivotably mounted relative to the at least one protective hood basic body.

13. The portable power tool according to claim 9, wherein:

the locking unit includes at least one spring element; and the at least one blocking element is movably mounted counter to a spring force of the at least one spring element.

14. The portable power tool according to claim 9, wherein the at least one protective hood basic body includes at least one first locking recess which corresponds to the at least one blocking element and defines the at least one first position of the at least one covering unit.

15. The portable power tool according to claim 7, wherein the locking unit is configured to lock the at least one covering unit relative to the at least one protective hood basic body in at least one further position in which the at least one covering unit at least partially releases the functional recess.

16. The portable power tool according to claim 7, wherein the at least one covering unit is displaceably mounted relative to the protective hood basic body.

17. The portable power tool according to claim 7, wherein the at least one covering unit is pivotably mounted relative to the at least one protective hood basic body.

* * * * *